US007161411B2

(12) United States Patent
Cirot et al.

(10) Patent No.: US 7,161,411 B2
(45) Date of Patent: Jan. 9, 2007

(54) CIRCUIT, METHOD AND SYSTEM FOR GENERATING A NON-LINEAR TRANSFER CHARACTERISTIC

(75) Inventors: Eric Yves Serge Cirot, Singapore (SG); Sze Kwang Tan, Singapore (SG); Mallikarjuna Rao Padala, Singapore (SG)

(73) Assignee: STMicroelectronics Asia Pacific Pte Ltd., Singapore (SG)

( * ) Notice: Subject to any disclaimer, the term of this patent is extended or adjusted under 35 U.S.C. 154(b) by 0 days.

(21) Appl. No.: 10/467,754

(22) PCT Filed: Feb. 20, 2001

(86) PCT No.: PCT/SG01/00025

§ 371 (c)(1),
(2), (4) Date: Apr. 19, 2004

(87) PCT Pub. No.: WO02/067183

PCT Pub. Date: Aug. 29, 2002

(65) Prior Publication Data

US 2004/0178840 A1 Sep. 16, 2004

(51) Int. Cl.
*G05F 1/10* (2006.01)
*G05F 3/16* (2006.01)

(52) U.S. Cl. ..... 327/541; 330/288; 323/315

(58) Field of Classification Search ..... 327/334, 327/355, 361, 538–541; 330/288; 323/315, 323/316

See application file for complete search history.

(56) References Cited

U.S. PATENT DOCUMENTS 4,525,682 A 6/1985 Lai et al. ..... 330/288
4,814,724 A * 3/1989 Tanigawa ..... 330/288
5,627,486 A * 5/1997 Gross ..... 327/108

FOREIGN PATENT DOCUMENTS

EP 0 481 277 A2 4/1992

OTHER PUBLICATIONS

Miropol'skiy, Y., "A Squarer," *Telecommunications and Radio Engineering* 46(6):70-72, Jun. 1991.

* cited by examiner

*Primary Examiner*—Kenneth B. Wells
(74) *Attorney, Agent, or Firm*—Lisa K. Jorgenson; E. Russell Tarleton; Seed IP Law Group PLLC

(57) ABSTRACT

A circuit, method and system for generating a non-linear transfer characteristic, including a plurality of current mirror circuits in parallel, each current mirror circuit having an offset current applied to an output terminal of an output-side transistor of the current mirror circuit for controlling an output current thereof, wherein the offset current of each current mirror circuit is set to a respective predetermined level, and the transfer characteristic is generated by summing the respective output currents of the current mirror circuits in a piece-wise manner.

31 Claims, 8 Drawing Sheets

Fig 1 : Prior art of multiplier configuration.

Fig 2a : Prior art of logarithmic-exponential configuration

Fig 2b : Schematic diagram for the logarithmic, amplification and anti-logarithmic block Fig 3 : Transfer characteristic of a non-linear function.

Fig 4 : Typical transfer characteristic

Fig 5 : Basic cell's circuit configuration

Fig 6 : Transfer characteristic of the proposed basic cell

CIRCUIT, METHOD AND SYSTEM FOR GENERATING A NON-LINEAR TRANSFER CHARACTERISTIC

BACKGROUND OF THE INVENTION

1. Field of the Invention

The present invention relates to a circuit, method, and system in which a transfer characteristic can be generated according to the specific requirements of an application. The transfer characteristic can be in the form of a power ($Ax^n$), quadratic ($Ax^n+BX^{n-1}$ . . . ), logarithmic ($\log_A B$), or any other non-linear form that is approximated by a sum of piece-wise-linear (PWL) functions.

2. Description of the Related Art

For analog scanning processors in a cathode ray tube (CRT), a transfer characteristic of power r (where r can be any real number, for instance from 1.5 to 4.5) is desirable for the horizontal dynamic focus (HDF) section of the scanning processor. This could previously only be realized by cascading several multipliers together, and the power of this transfer characteristic is limited by r being an integer. Moreover, the complexity of using the multiplier configuration will increase if a higher power transfer characteristic is to be realized.

In this section, two different approaches to generating the same transfer characteristics are discussed. Although the discussion touches on the multiplier configuration and the logarithmic-exponential configuration, it can be extended to other configurations or circuits in which any form of transfer characteristics is to be implemented.

The first configuration uses multipliers and switches and is shown in FIG. 1. Switch S1 is used to select the input to the second multiplier block such that the overall transfer characteristic can either have a power of 3 or 4. Switch S2 selects the output signal either from the first or second multiplier block so as to obtain the correct transfer characteristic.

In FIG. 1, the system comprises basic multiplier cells that are only able to produce a transfer characteristic in the form of ($\text{Input}^r$), where the power, r, is limited to an integer number. If a system needs a power that is a real number (i.e., 2.6), a designer will tend to implement the multiplier to provide a power of 2 or 3 as an approximation. If a power of higher order, for example 7 or 8, is to be designed, then the circuit geometry will increase in size and/or complexity. Furthermore, if the system is required to be able to select from a range of power terms, numerous switches have to be implemented to select the inputs for each multiplier, and also to select the desired signal at the output. This will further increase the size of the system.

The second configuration consists of logarithmic-exponential transforms and an amplifier. The transfer characteristic in the form of Input, can be expressed in another form as shown below.

$$f(\text{Input})=\text{Input}^r(=e^{r(ln(Input))}\ \text{In: natural log}$$

With this new representation, it shows that this system can be implemented using another approach. This approach mainly consists of 3 sections, and the block diagram for each section is shown in FIG. 2*a*. First, a logarithmic transform has to be supplied to the input, where the result of the transform is (ln(Input)). Next, it is necessary to amplify the product with a constant value (r). Finally, an exponential transform is done.

With this approach, a system with a different power term can be generated by controlling the amplification factor in the amplification block. However, there are drawbacks to this approach. A basic logarithmic amplifier is shown in FIG. 2*b*. This basic logarithmic amplifier consists of an operational amplifier, an input resistor, $R_{in}$, that is used to convert the voltage input, $V_{input}$, to a current input, $I_s$, and an NPN transistor that is used to convert the current input to a logarithmic voltage output, $V_{output}$. From the transfer function of this logarithmic block as shown in FIG. 2*b*, it can be seen that the output is dependent on the process parameter, $I_s$. Moreover, this logarithmic amplifier employs negative feedback, which means that the issue of control stability should be considered. Furthermore, this circuit exhibits a strong temperature dependence due to the thermal voltage, $V_T$ as well as $V_{in}/R_{in}$ or Is. This dependence can be significantly reduced by using various compensation techniques. These compensation techniques may require extra components to be added, which would increase the circuit geometry.

BRIEF SUMMARY OF THE INVENTION

The disclosed embodiments of the present invention provide a circuit for generating a non-linear transfer characteristic. The circuit includes a plurality of current mirror sub-circuits operating in parallel within the circuit, each current mirror sub-circuit having an offset current applied to an output terminal of an output-side transistor of the current mirror sub-circuit for determining an output current of the current mirror sub-circuit, whereby the transfer characteristic is generated by setting the offset current of each current mirror sub-circuit at respective predetermined levels and summing the respective output currents of the current mirror sub-circuits.

The embodiments of the present invention also provide a method for generating a non-linear transfer characteristic, including the steps of providing a circuit having a plurality of current mirror sub-circuits operating in parallel within the circuit, each current mirror sub-circuit having an offset current applied to an output terminal of an output-side transistor of the current mirror sub-circuit for determining an output current of the current mirror sub-circuit; and generating the transfer characteristic by setting the offset current of each current mirror sub-circuit at respective predetermined levels and summing the respective output currents of the current mirror sub-circuits.

Preferably, the offset current of each current mirror sub-circuit is adjustable to modify the transfer characteristic. Preferably, the transistors of each current mirror sub-circuit are NPN bipolar junction transistors (BJTs). Alternatively, the transistors are PNP BJTs. Alternatively, the circuit is made up of a combination of NPN and PNP current mirror subcircuits. Alternatively, the transistors are NMOS or PMOS.

Preferably, positive slope components of the transfer characteristic are provided by NPN current mirror sub-circuits and negative slope components of the transfer characteristic are provided by PNP current mirror sub-circuits. Alternatively, positive slope components of the transfer characteristic are provided by PNP current mirror sub-circuits and negative slope components of the transfer characteristic are provided by NPN current mirror subcircuits.

The embodiments of the present invention also include a system for generating a non-linear transfer characteristic, including a plurality of current mirror circuits in parallel, each current mirror circuit having an offset current applied to an output terminal of an output-side transistor of the current mirror circuit for controlling an output current thereof, wherein the offset current of each current mirror circuit is set to a respective predetermined level, and whereby the transfer characteristic is generated by summing the respective output currents of the current mirror circuits.

The current mirror circuit of the present invention can be used in conjunction with a plurality of other current mirror circuits for generating a transfer characteristic, the circuit including matched input and output transistors connected in current mirror configuration, the output transistor having an offset current applied to an emitter terminal thereof for adjusting an output current of the current mirror circuit, whereby the output current can be summed with output currents of the other current mirror circuits to generate a piece-wise linear transfer characteristic.

Preferably, the system is a horizontal dynamic focus adjustment system for use in a cathode ray tube. Preferably, the non-linear transfer characteristic is in the form of a characteristic of the form $y=x^r$, where x is the input, y is the output and r is a real number adjustable between range limits $r_1$ and $r_2$. These range limits can be set as necessary, for example for a EW Pincushion curve with a W-shape form (East-West geometry correction), $r_1$ may be 1.5 and $r_2$ may be 2.5. In an alternative example, for horizontal dynamic focus adjustment, $r_1$ may be 2.0 and $r_2$ may be 4.5.

Advantageously, embodiments of the present invention can provide a transfer characteristic having real values of r, where it is desired to have a characteristic of the form $y=x^r$, and in fact r is adjustable through adjustment of the offset currents of the current mirror sub-circuits. Also, there is no need for switching of the signal at the input and output and the circuit geometry remains the same for a system having 1 power term or, for example, 10 power terms.

Advantageously, the invention does not employ negative feedback, and therefore the stability issue does not come into play. Fewer components are needed to realize the same transfer characteristic, and it does not depend on the process parameter, $I_s$.

Advantageously, the invention allows an end user of a CRT system to adjust the transfer characteristic, and hence the image displayed by the CRT, by adjusting an external offset current control.

BRIEF DESCRIPTION OF THE SEVERAL VIEWS OF THE DRAWING(S)

FIG. 1 is a block diagram of a prior art system for generating a non-linear transfer characteristic;

FIG. 2*a* is a block diagram of a prior art logarithmic exponential configuration for generating a transfer characteristic;

FIG. 2*b* is a schematic circuit diagram of the configuration shown in FIG. 2*a;*

DETAILED DESCRIPTION OF THE INVENTION

A basic idea of the invention is to sum several piece-wise linear functions to obtain the desired transfer characteristics. Any function, for example, logarithmic, quadratic, etc, can be approximated in the following form:

$$f(t) = \sum_{n=0}^{\infty} A_n t^n$$
$$= B(t-t_0)u(t-t_0) + C(t-t_1)u(t-t_1) + D(t-t_2)u(t-t_2) + \ldots$$

where $t_0<t_1<t_2<t_{n-1}$ for n>4 and $t_0>0$ and where $u(t-t_0)$ is a unit step function of magnitude 1 when $t>t_0$ and zero otherwise. For example, the transfer characteristic shown in FIG. 3 can be expressed in following form:

$$f(t)=1(t-1)u(t-1)-(t-2)u(t-2)+2(t-3)u(t-3)-2(t-4)u(t-4)$$

Figure 1:
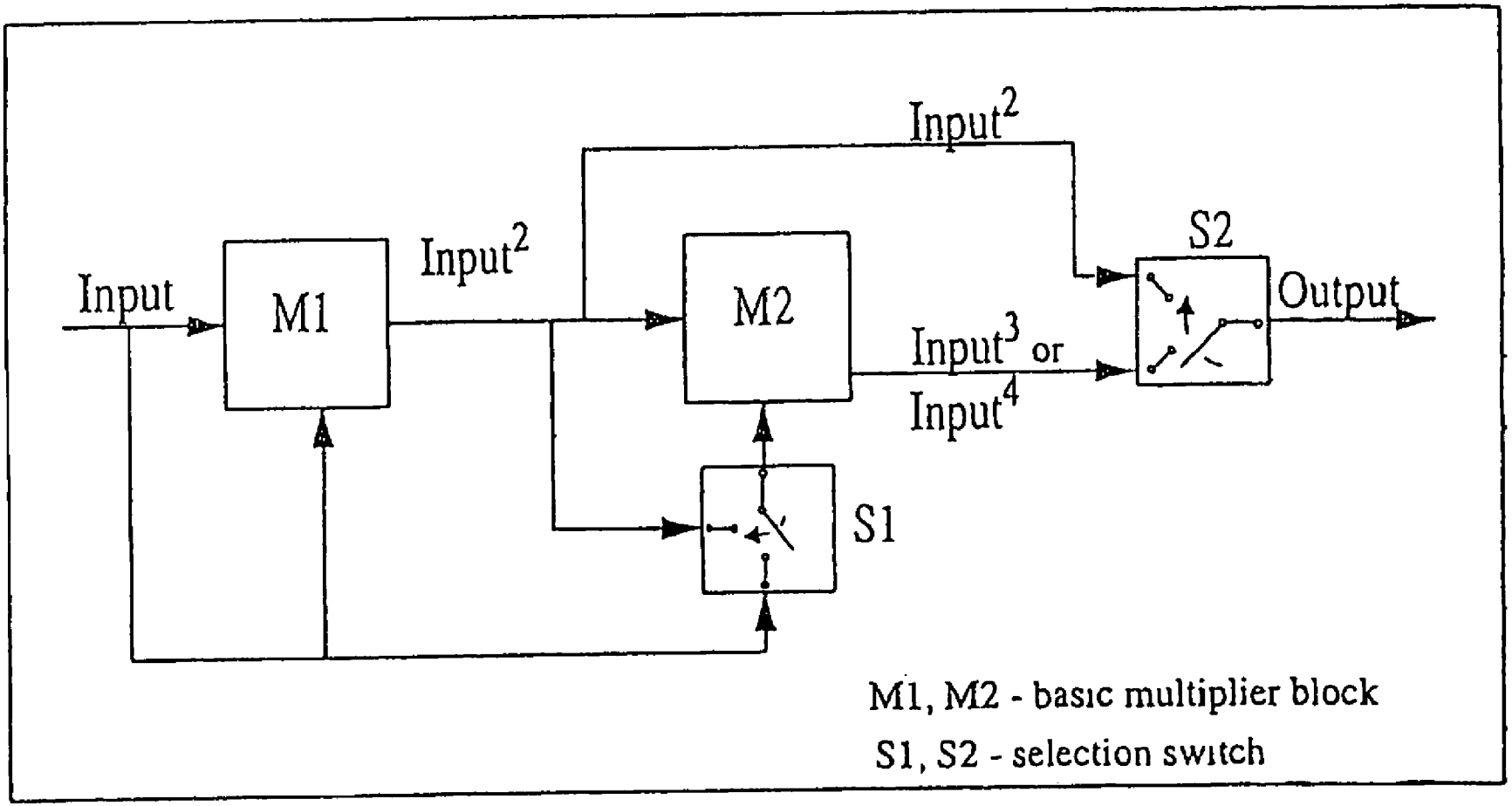
Figure 2:
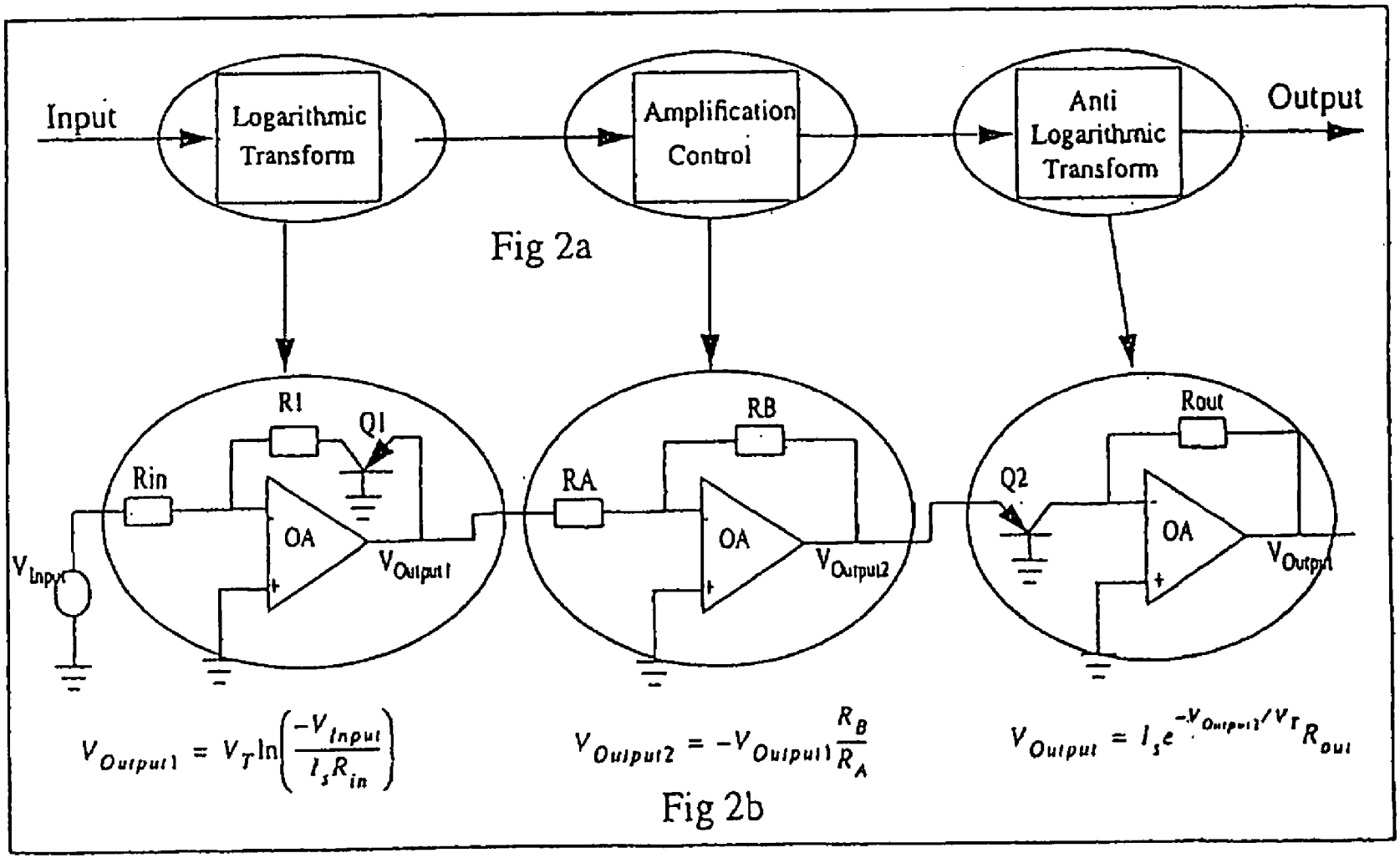
Figure 3:
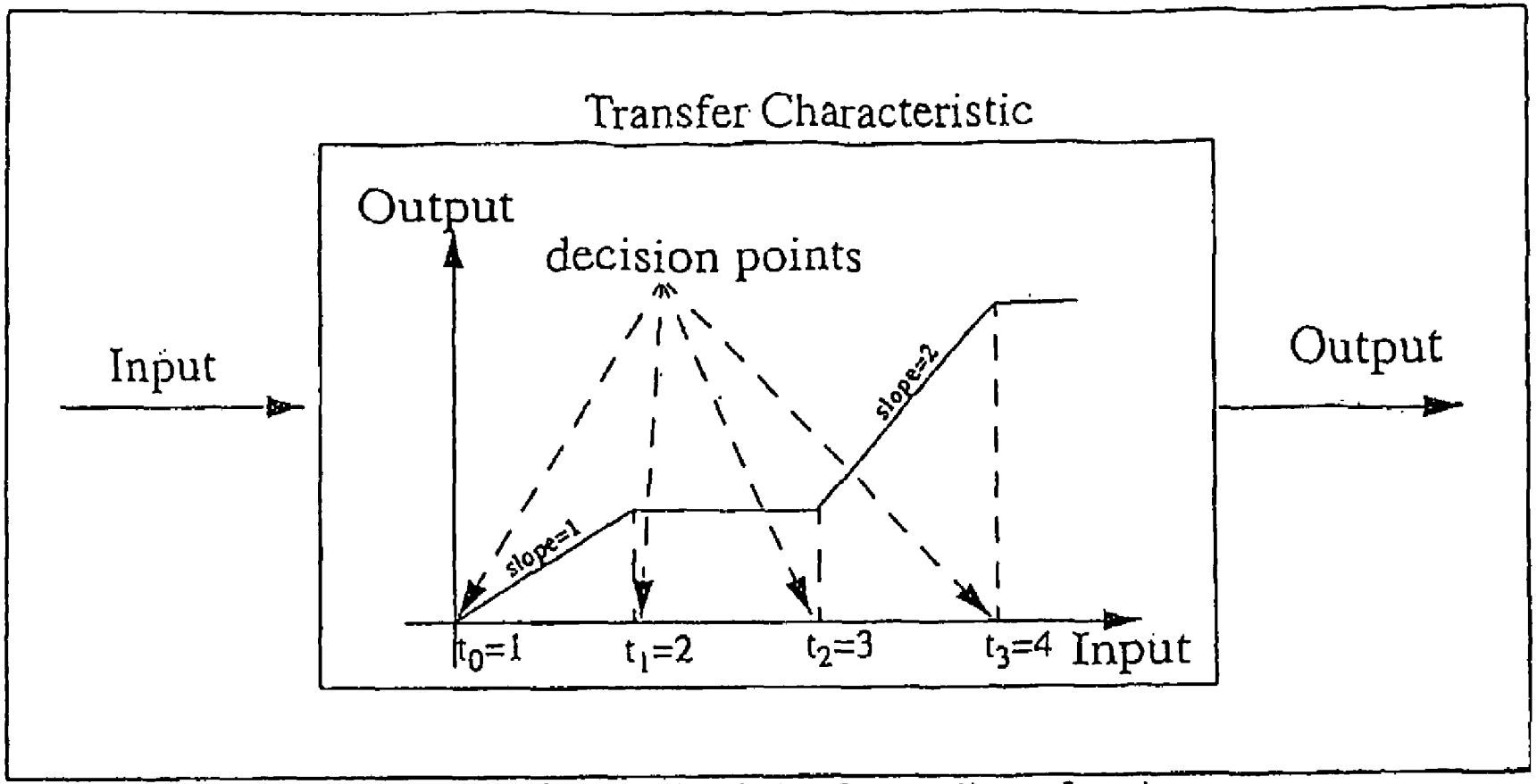
FIG. 3 is an example transfer characteristic of a non-linear function.
Figure 4:
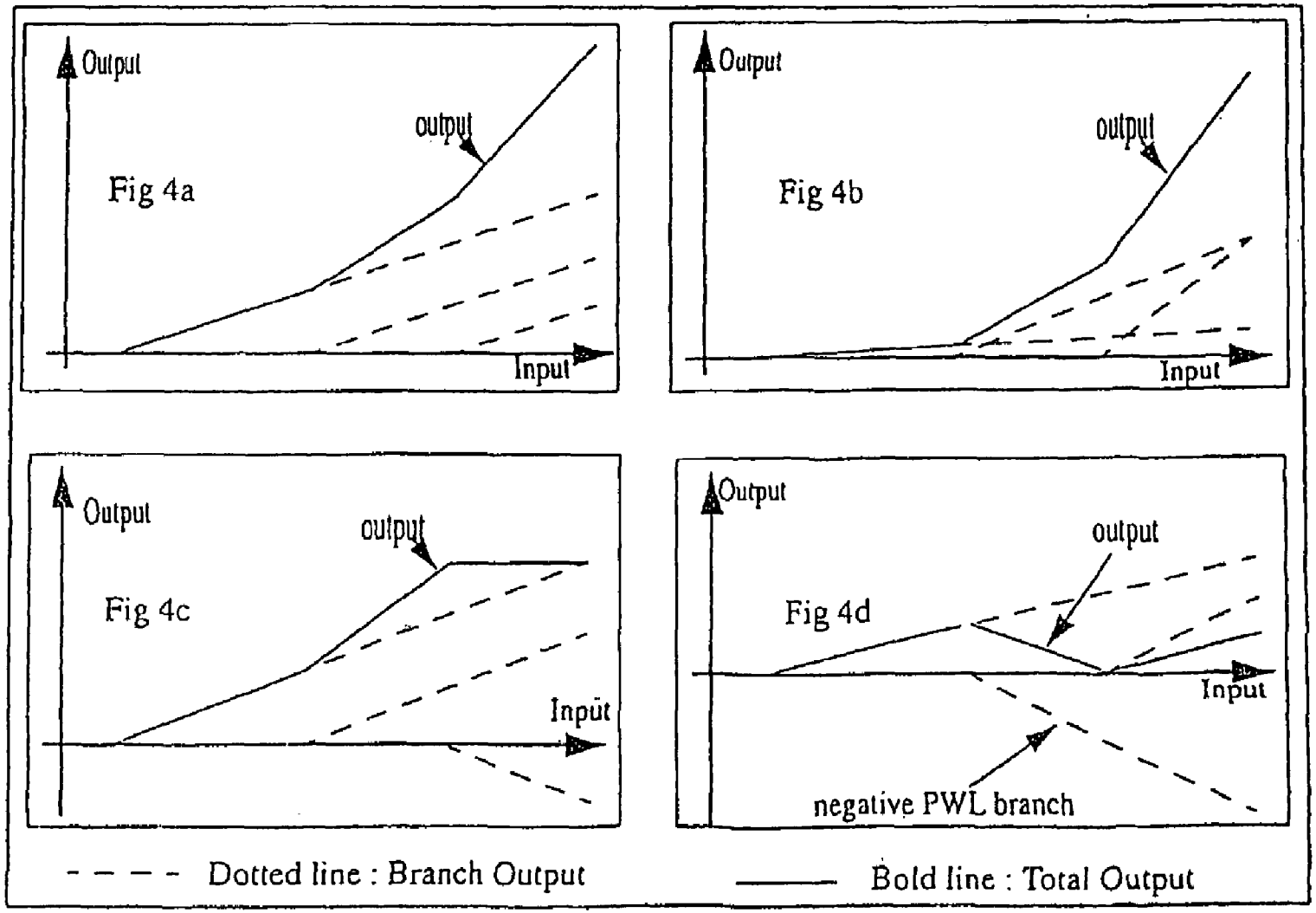
FIG. 4 are four examples of non-linear transfer characteristics formed in a piece-wise linear manner.

By forming such piece-wise linear (PWL) functions, any kind of transfer characteristic can be approximated. It is desirable to control two parameters of each of these PWL functions: the time of the conduction corners, (i.e., $t_0$, $t_1$, $t_2$, etc.) as shown in FIG. 3, and also the slope at each corner. In FIG. 4, the branch outputs indicate the components of the PWL function and bold lines indicate the total output by summing the individual branches. From the plots shown in FIG. 4, it can be seen that by controlling the conduction corner and slope of each branch, any kind of transfer characteristic can be implemented. More branches are needed for a system with a more complicated transfer characteristic. For a more complex transfer characteristic, for example, $f(\text{Input})=\text{Input}^2$, increasing the number of branches for a specific input range and output magnitude will make the output curve more accurate.

Figure 5:
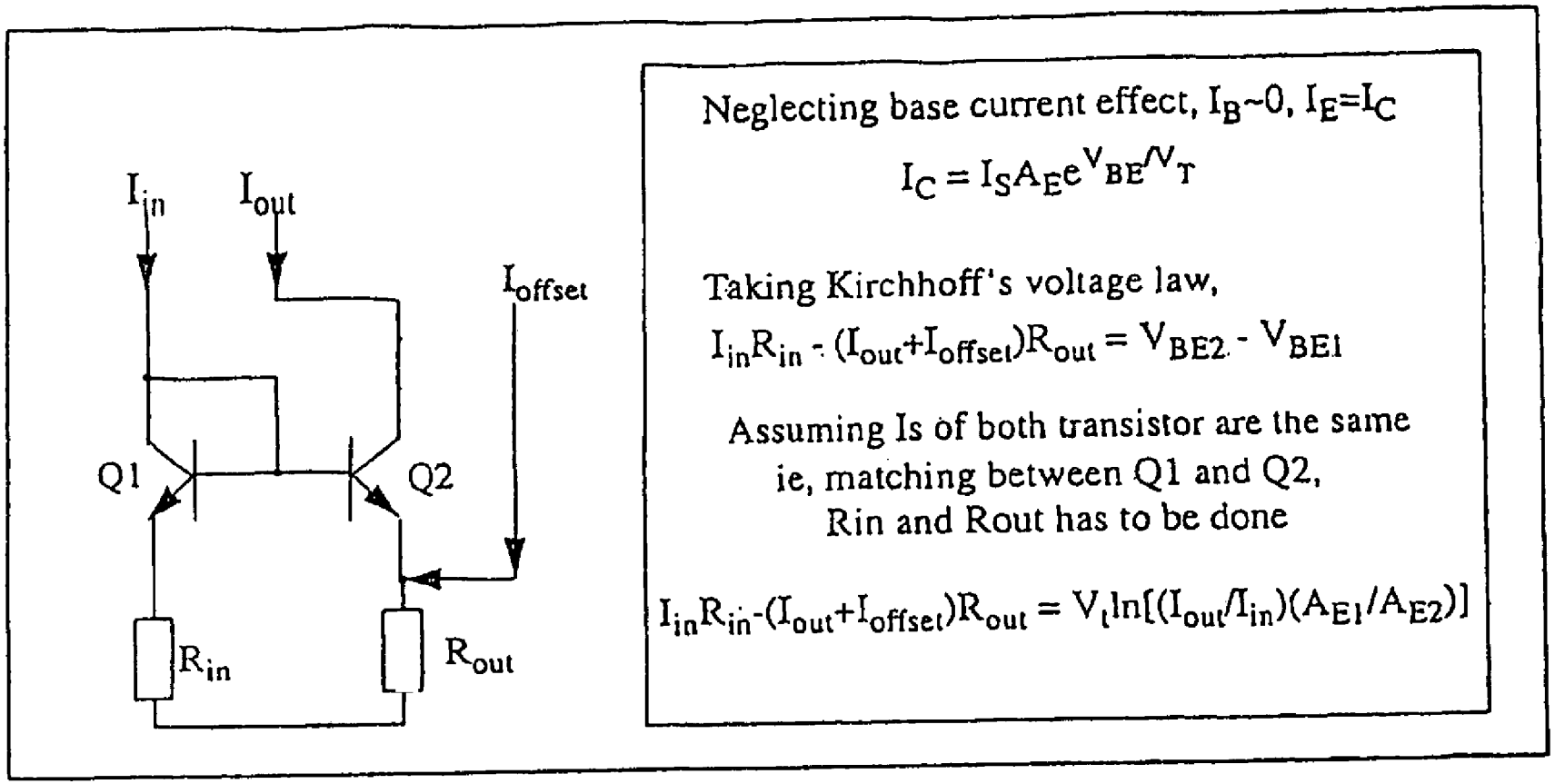
FIG. 5 is a diagram of a current mirror circuit in accordance with an embodiment of the invention.

The circuit configuration of a current mirror, which forms the basic cell of the invention, is shown in FIG. 5. The input stage consists of an NPN transistor, Q1, and an emitter resistor ($R_{in}$). The output stage consists of an NPN transistor, Q2, an emitter resistor ($R_{out}$), and a current source ($I_{offset}$) that is applied to the emitter of Q2. The ratio of both the transistors and resistors set the amplification factor or slope, and the $I_{offset}$ current is used to set the conduction corner. The output of the basic cell can be connected easily to other cells because of the open configuration of the circuit. NPN transistor cells as well as PNP transistor cells can be used to build a larger circuit having the desired transfer characteristic. With NPN and PNP basic cells, transfer characteristics as shown in FIGS. 4*c* and 4*d* can be implemented with the PNP cell realizing the negative branch of the PWL function. The input of the basic cell is considered to be a current signal. The input current drives a current output of a positive or negative slope according to the cell characteristics and is generated by an input system such as a voltage-to-current converter or a transconductance system.

In the basic cell, instead of NPN and PNP BJTs, N-type and P-type MOS transistors can be used with equal effect.

The equation governing the NPN basic cell is shown below:

$$I_{in}R_{in}-(I_{out}+I_{offset})R_{out}=V_T ln[(I_{out}/I_{in})(A_{E1}/A_{E2})] \quad (1)$$

where: $V_T$ is the thermal voltage of the transistors; $I_{in}$, $I_{out}$ are the current mirror input and output currents, respectively; $A_{E1}$, $A_{E2}$ are the emitter areas of Q1 and Q2, respectively. If MOS type devices are used instead of BJTs, the above equation will follow the model of the relevant MOS device used.

Figure 6:
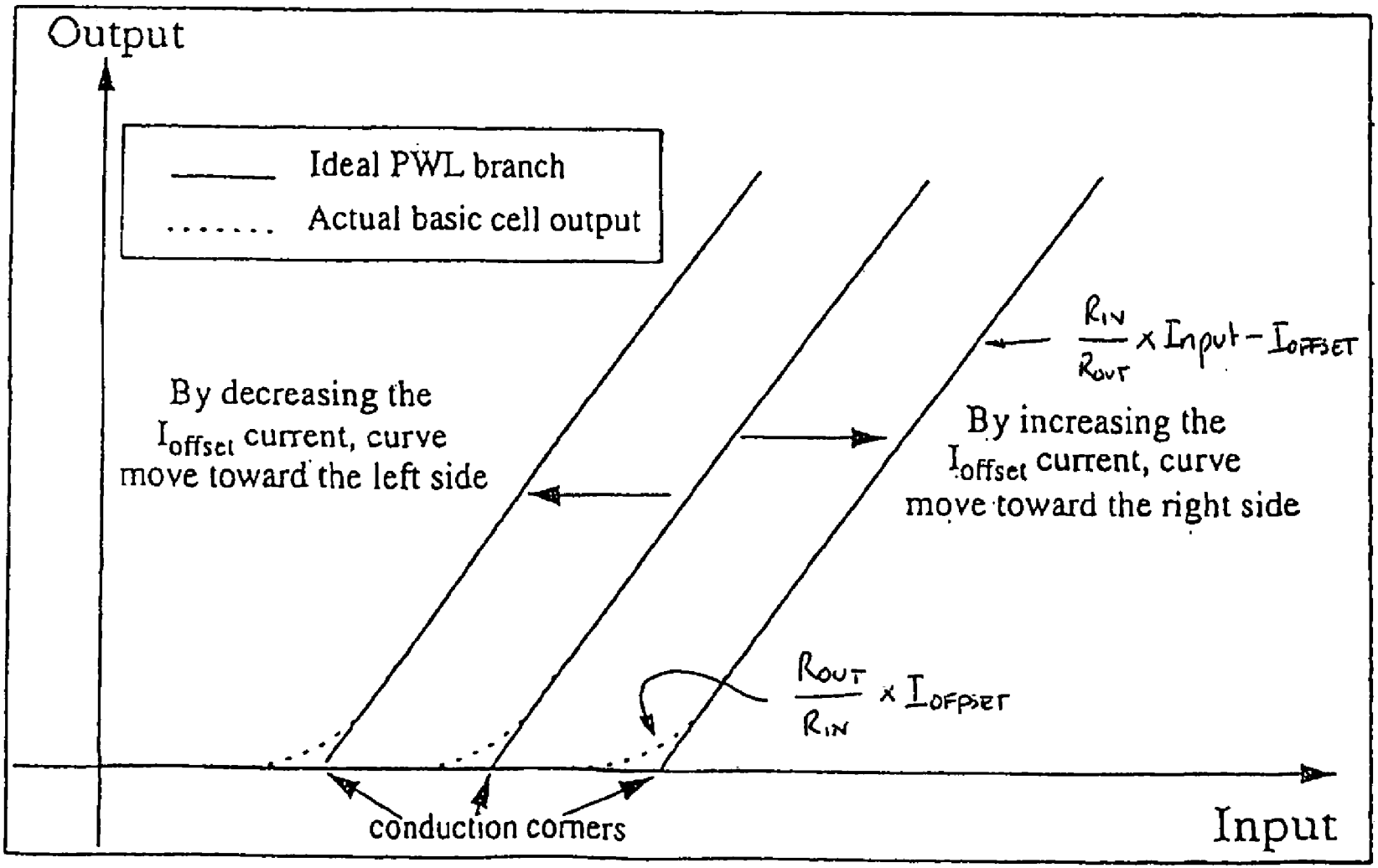
FIG. 6 is a diagram of an example transfer characteristic of the current mirror circuit of FIG. 5.

As can be seen from FIG. 6, the transfer characteristic is governed by a linear part and a non-linear part, given respectively by:

$$\text{Output} = \frac{R_{in}}{R_{out}} \times \text{Input} - I_{offset} \text{ (linear)} \tag{2}$$

$$\text{Input} = \frac{R_{out}}{R_{in}} \times I_{offset} \text{ (non-linear)} \tag{3}$$

By observing equation (1), and making certain assumptions, the formula for the conduction corner (equation (3) above) can be derived. Equation (3) models the conduction corner as the output transistor starts to conduct, at which point the output current is small relative to the input current.

Assumption 1: Taking the emitter area of both the input and output transistors to be the same. Hence $A_{E1}$ will be equal to $A_{E2}$.

Assumption 2: At the point where the output transistor starts to conduct, $I_{out}$ is small compared to $I_{offset}$.

Assumption 3: If $R_{out}I_{offset}>R_{in}I_{in}$, the output transistor cannot conduct, hence $I_{in}<R_{out}I_{offset}/R_{in}$.

It is important for the circuit designer to choose appropriate characteristics of the conduction corner in order to achieve the desired accuracy of the output curve. This is a matter of choosing the values of $R_{in}$ and $R_{out}$, taking into account the temperature effect on the output current of the $V_T$ term from equation (1).

When an input current is present, the potential at the base and emitter of Q1 will increase. A voltage comparison at the base and emitter of Q2 determines whether Q2 conducts. The potential at the emitter is set by $I_{offset}R_{out}$, and this setpoint can be changed easily through the offset current. Q2 will start to conduct when $I_{in}R_{in}$ is greater than $I_{offset}R_{out}$. The output current of this basic cell will be summed together with other cells to form the output current of the system. The number of branches in the PWL function, and hence the number of basic cells required, will depend on the complexity of the desired transfer characteristic.

The transfer characteristic of a basic current mirror cell is shown in FIG. 6. Bold lines indicate the theoretical PWL branch while dotted lines show the actual transfer characteristic of the basic cell. By modulating the offset current $I_{offset}$, it is possible to change the transfer characteristic, thereby providing a controllable adjustment. By increasing $I_{offset}$, the output branch will shift to the right. Similarly by decreasing $I_{offset}$, the output branch can be shifted to the left. In FIG. 6, the dotted line gives the actual transfer characteristic of the basic cell. The transfer characteristic of the basic cell is the same as the theoretical PWL branch except at the conduction corner. The non-linearity of the transistor effectively allows the curve to be smoothed at the conduction corner. This does not represent a problem for the system, but instead it advantageously smoothes the output. In this way, so-called W-, S-, and C-corrections can be implemented in the horizontal or vertical directions (as appropriate) for controlling the display on a CRT screen.

Figure 7:
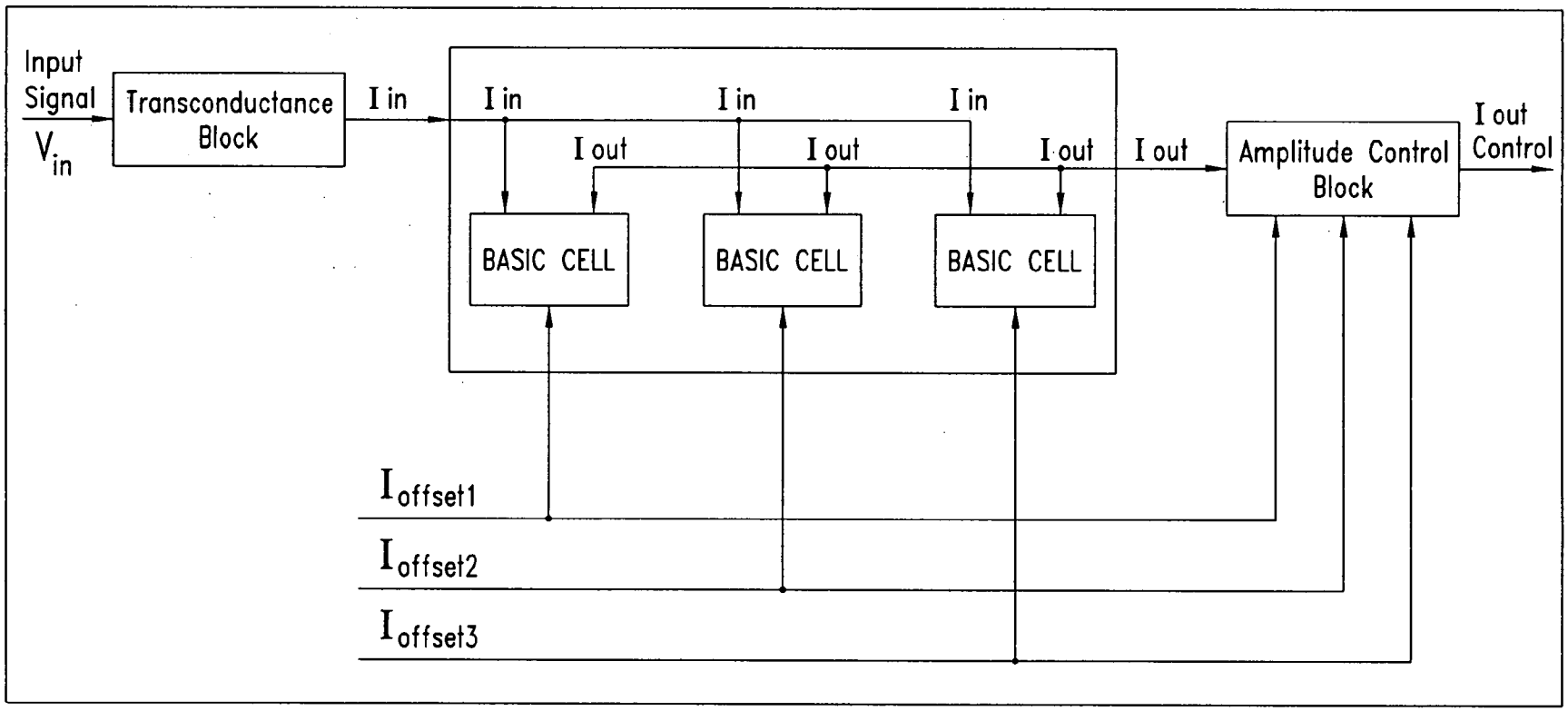
FIG. 7 is a block diagram of a system formed in accordance with an embodiment of the invention.

A block diagram of a system of an embodiment of the invention is shown in FIG. 7. In this system, we define the input as a voltage source, $V_{in}$, and hence a transconductance circuit is needed to convert the voltage input to a current input, $I_{in}$. $I_{in}$ then acts as the input to a circuit comprising basic PNP or NPN cells, or both, depending on the transfer desired characteristic. The output is then fed into an amplitude control circuit to obtain the same magnitude at the maximum input signal for each different transfer characteristic. The necessity of the amplitude control circuit can be seen from FIG. 6. By adjusting $I_{offset}$, the output current amplitude is altered. In the exemplary system shown in FIG. 7, three adjustment signals are used, namely $I_{offset1}$, $I_{offset2}$ and $I_{offset3}$. By modulating $I_{offset1}$ the power ($V_{in}^{r}$, r is the power) of the proposed invention can be changed from $r_1$ to $r_2$ where $r_1$ and $r_2$ can be any arbitrary positive real numbers. Next, with $I_{offset1}$ a particularly interesting aspect is that $I_{offset2}$, $I_{offset3}$ can be a combination of the first $I_{offset1}$. In this way, it is possible to generate a complete transfer characteristic that is easily adjustable by way of a single or multiple current controls.

Figure 8:
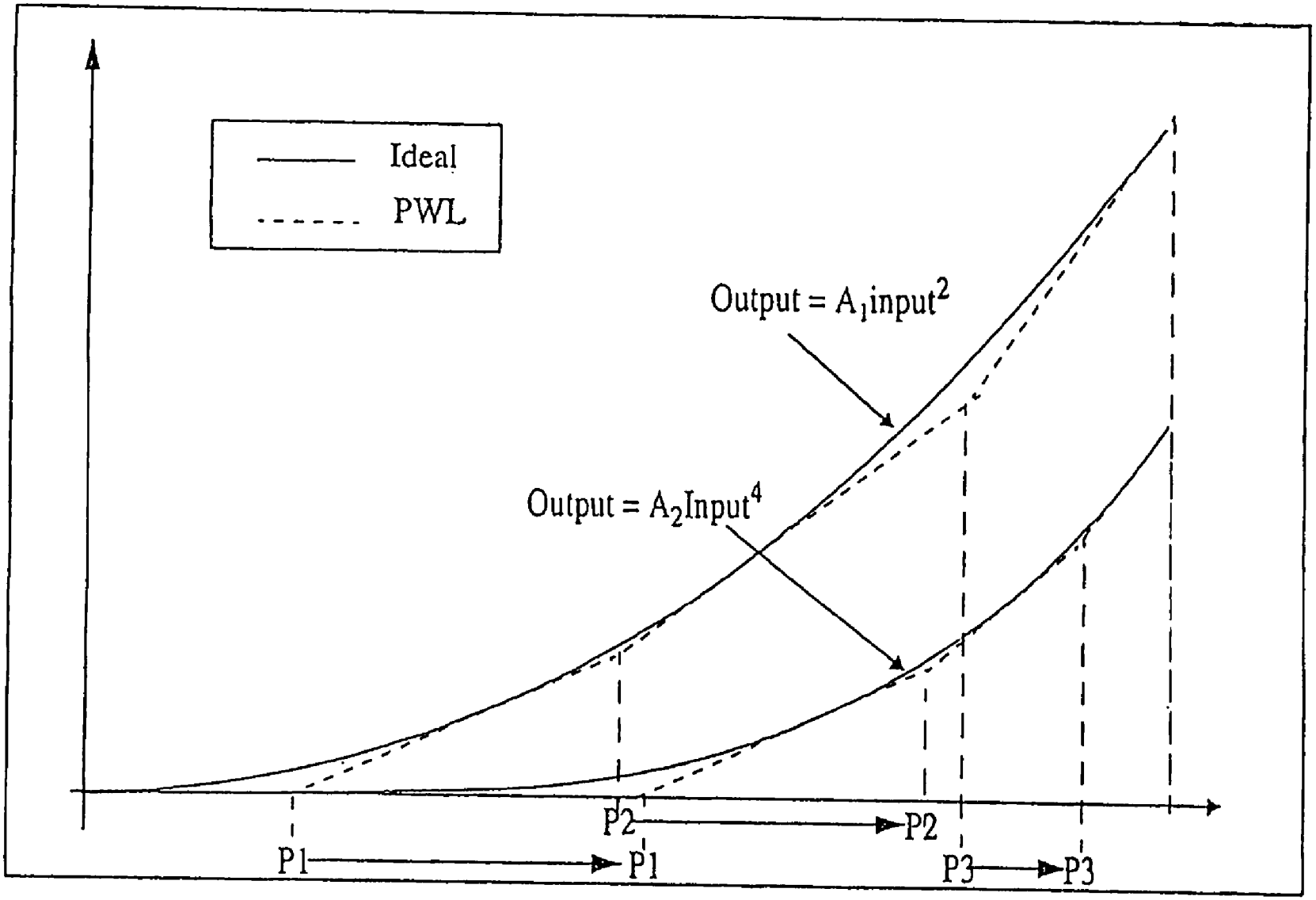
FIG. 8 illustrates example transfer characteristics generated in accordance with an embodiment of the invention.

As shown in FIG. 8, it is possible to convert a curve of the form output=$A_1$input$^2$ to a curve of the form output=$A_2$input$^4$, where $A_1$ and $A_2$ are constants, by adjusting the offset currents in order to move the conduction corners, P1, P2 and P3. This dynamic adjustability advantageously allows dynamic adjustment of the transfer characteristic.

All of the above U.S. patents, U.S. patent application publications, U.S. patent applications, foreign patents, foreign patent applications and non-patent publications referred to in this specification and/or listed in the Application Data Sheet, are incorporated herein by reference, in their entirety.

From the foregoing it will be appreciated that, although specific embodiments of the invention have been described herein for purposes of illustration, various modifications may be made without deviating from the spirit and scope of the invention. Accordingly, the invention is not limited except as by the appended claims.

The invention claimed is:

1. A circuit for generating a non-linear transfer characteristic, comprising:

a plurality of current mirror sub-circuits operating in parallel within the circuit, each current mirror sub-circuit configured to have an offset current applied to an output terminal of an output-side transistor of the current mirror sub-circuit for determining an output current of the current mirror sub-circuit, each current mirror sub-circuit configured to have an offset current set at a respective predetermined level, and the transfer characteristic defined by the sum of the respective output currents of the current mirror sub-circuits.

2. The circuit of claim 1 wherein the offset current of each current mirror sub-circuit is adjustable to modify the transfer characteristic.

3. The circuit of claim 1 wherein the output transistor of each current mirror subcircuit is an NPN bipolar junction transistor (BJTs).

4. The circuit of claim 1 wherein the output transistor of each current mirror subcircuit is an PNP BJT.

5. The circuit of claim 1 wherein the circuit comprises a combination of NPN and PNP current mirror sub-circuits.

6. The circuit of claim 1 wherein the output transistor of each current mirror subcircuit is one of an N-type or a P-type MOS transistor.

7. The circuit of claim 5 wherein positive slope components of the transfer characteristic are provided by NPN current mirror sub-circuits and negative slope components of the transfer characteristic are provided by PNP current mirror sub-circuits.

8. The circuit of claim 5 wherein positive slope components of the transfer characteristic are provided by PNP current mirror sub-circuits and negative slope components of the transfer characteristic are provided by NPN current mirror sub-circuits.

9. The circuit of claim 1 wherein the non-linear transfer characteristic is a piece-wise approximation of a characteristic of the form $y=x^r$, where x is an input signal, y is output signal, and r is a real number adjustable between range limits $r_1$ and $r_2$ by adjustment of the offset current of one or more of the current mirror sub-circuits.

10. A method for generating a non-linear transfer characteristic, including the steps of:

providing a circuit having a plurality of current mirror sub-circuits operating in parallel within the circuit, and configuring each current mirror sub-circuit to have an offset current applied to an output terminal of an output-side transistor of the current mirror sub-circuit for determining an output current of the current mirror sub-circuit; and generating the transfer characteristic by setting the offset current of each current mirror sub-circuit at respective predetermined levels and summing the respective output currents of the current mirror sub-circuits.

11. The method of claim 10, further including the step of adjusting the offset current of each current mirror sub-circuit to modify the transfer characteristic.

12. The method of claim 10 wherein providing the circuit comprises forming the transistors of each current mirror subcircuit NPN bipolar junction transistors.

13. The method of claim 10 wherein providing the circuit comprises forming the transistors of each current mirror subcircuit from PNP BJTs.

14. The method of claim 10 wherein providing the circuit comprises providing a combination of NPN and PNP current mirror sub-circuits.

15. The method of claim 10 wherein providing the circuit comprises forming the transistors of each current mirror subcircuit from one of N-type and P-type MOS transistors.

16. The method of claim 14 wherein positive slope components of the transfer characteristic are provided by NPN current mirror sub-circuits and negative slope components of the transfer characteristic are provided by PNP current mirror sub-circuits.

17. The method of claim 14 wherein positive slope components of the transfer characteristic are provided by PNP current mirror sub-circuits and negative slope components of the transfer characteristic are provided by NPN current mirror sub-circuits.

18. The method of claim 10 wherein the non-linear transfer characteristic is a piecewise approximation of a characteristic of the form $y=x_r$, where x is an input signal, y is an output signal and r is a real number adjustable between range limits $r_1$ and $r_2$ by adjustment of the offset current of one or more of the current mirror sub-circuits.

19. A system for generating a non-linear transfer characteristic, comprising: a plurality of current mirror circuits in parallel, each current mirror circuit configured to have an offset current applied to an output terminal of an output-side transistor of the current mirror circuit for controlling an output current thereof, the offset current of each current mirror circuit is set to a respective predetermined level, whereby the transfer characteristic is generated by summing the respective output currents of the current mirror circuits.

20. The system of claim 19 wherein the offset current of each current mirror circuit is adjustable to modify the transfer characteristic.

21. The system of claim 19 wherein the transistors of each current mirror circuit are NPN bipolar junction transistors.

22. The system of claim 19 wherein the transistors of each current mirror circuit are PNP BJTs.

23. The system of claim 19 wherein the circuit comprises a combination of NPN and PNP current mirror circuits.

24. The system of claim 19 wherein the transistors of each current mirror circuit are N-type or P-type MOS transistors.

25. The system of claim 23 wherein positive slope components of the transfer characteristic are provided by NPN current mirror circuits and negative slope components of the transfer characteristic are provided by PNP current mirror circuits.

26. The system of claim 23 wherein positive slope components of the transfer characteristic are provided by PNP current mirror circuits and negative slope components of the transfer characteristic are provided by NPN current mirror circuits.

27. The system of claim 19 wherein the non-linear transfer characteristic comprises a piecewise approximation of a characteristic of the form $y=x_r$, where x is an input signal, y is an output signal, and r is a real number adjustable between range limits $r_1$ and $r_2$ by adjustment of the offset current of one or more of the current mirror circuits.

28. The system of any one of claims 19 to 27 wherein the system is a horizontal dynamic focus adjustment system for use in a cathode ray tube.

29. A system for generating a non-linear transfer characteristic, the system comprising:

a plurality of current mirror circuits coupled in parallel, each current mirror circuit comprising:

a first transistor having a collector terminal coupled to a first current source, a control terminal coupled to the collector terminal, and an emitter terminal coupled to a first terminal of an input resistor;

a second transistor having a collector terminal coupled to a second current source, a control terminal coupled to the control terminal of the first transistor, and an emitter terminal coupled to a first terminal of an output resistor, the output resistor having a second terminal coupled to a second terminal of the input resistor; and an offset current source having an output coupled to the emitter terminal of the second transistor, the current mirror circuit having a transfer characteristic that is modulated by the offset current from the offset current source.

30. The system of claim 29 wherein the circuit is configured to shift an output signal to the right along an input axis of a graph of the transfer characteristic when the offset current is increased, and to shift the output to the left when the offset current is decreased.

31. The system of claim 29, comprising a horizontal dynamic focus adjustment system for use in a cathode ray tube that includes the plurality of current mirror circuits.

* * * * *